US007572208B2

(12) United States Patent
Brewer

(10) Patent No.: US 7,572,208 B2
(45) Date of Patent: Aug. 11, 2009

(54) CLIMBING WALL WITH BRAKING MECHANISM

(75) Inventor: George W. Brewer, Newton, MA (US)

(73) Assignee: Brewer's Ledge, Inc., Boston, MA (US)

( * ) Notice: Subject to any disclaimer, the term of this patent is extended or adjusted under 35 U.S.C. 154(b) by 243 days.

(21) Appl. No.: 11/776,972

(22) Filed: Jul. 12, 2007

(65) Prior Publication Data

US 2008/0015090 A1 Jan. 17, 2008

Related U.S. Application Data

(60) Provisional application No. 60/807,273, filed on Jul. 13, 2006.

(51) Int. Cl.
*A63B 9/00* (2006.01)

(52) U.S. Cl. ..... 482/37; 482/7; 482/51

(58) Field of Classification Search ..... 482/1, 482/4, 7, 23, 37, 51–52, 69, 95; 198/832.2, 198/832.3; *A63B 9/00, 22/02, 27/00, 29/00*
See application file for complete search history.

(56) References Cited

U.S. PATENT DOCUMENTS 1,744,650 A * 1/1930 Leonard ..... 198/794
3,497,215 A * 2/1970 Harrison et al. ..... 482/53
3,592,466 A * 7/1971 Parsons ..... 482/53
5,125,877 A * 6/1992 Brewer ..... 482/7
5,549,195 A * 8/1996 Aulagner et al. ..... 198/850
6,095,952 A * 8/2000 Ali et al. ..... 482/54
6,231,482 B1 * 5/2001 Thompson ..... 482/37
6,860,836 B1 * 3/2005 Wu ..... 482/37
7,195,582 B2 * 3/2007 Wu ..... 482/37
7,357,757 B2 * 4/2008 Brown ..... 482/37

* cited by examiner

*Primary Examiner*—Loan H Thanh
*Assistant Examiner*—Oren Ginsberg
(74) *Attorney, Agent, or Firm*—Kurt Rauschenbach; Rauschenbach Patent Law Group, LLC

(57) ABSTRACT

A climbing wall includes a frame with a guiding channel. A plurality of panels slide in the guiding channel and present a climbing surface with protrusions for climbing. The frame includes a section where the plurality of panels pivot out of the guiding channel when loaded with a climber's weight. An actuator is engaged by torque generated when one of the plurality of panels pivots out of the guiding channel. A braking mechanism is coupled to the actuator. The braking mechanism applies an arresting force to the plurality of panels when the actuator is engaged.

19 Claims, 2 Drawing Sheets

CLIMBING WALL WITH BRAKING MECHANISM

RELATED APPLICATION SECTION

This application claims priority to U.S. Provisional Patent Application Ser. No. 60/807,273, filed Jul. 13, 2006, entitled "Actuator For Climbing Wall Braking Mechanism", the entire application of which is incorporated herein by reference.

The section headings used herein are for organizational purposes only and should not be construed as limiting the subject matter described in the present application.

BACKGROUND OF THE INVENTION

The popularity of rock climbing has created a market for artificial climbing walls. Climbing walls with continuous sliding belts have been recently developed to accommodate climbers who have limited space. These climbing walls provide a continuous climbing surface for recreation, training and fitness purposes. Some known climbing walls with continuously sliding belts are powered by electric motors. Other climbing walls, such as the climbing walls manufactured by Brewer's Ledge Inc., the assignee of the present application, use the climber's own weight to power the sliding belts.

BRIEF DESCRIPTION OF THE DRAWINGS

The aspects of this invention may be better understood by referring to the following description in conjunction with the accompanying drawings. Identical or similar elements in these figures may be designated by the same reference numerals. Detailed description about these similar elements may not be repeated. The drawings are not necessarily to scale. The skilled artisan will understand that the drawings, described below, are for illustration purposes only. The drawings are not intended to limit the scope of the present teachings in any way.

DETAILED DESCRIPTION

Figure 1:
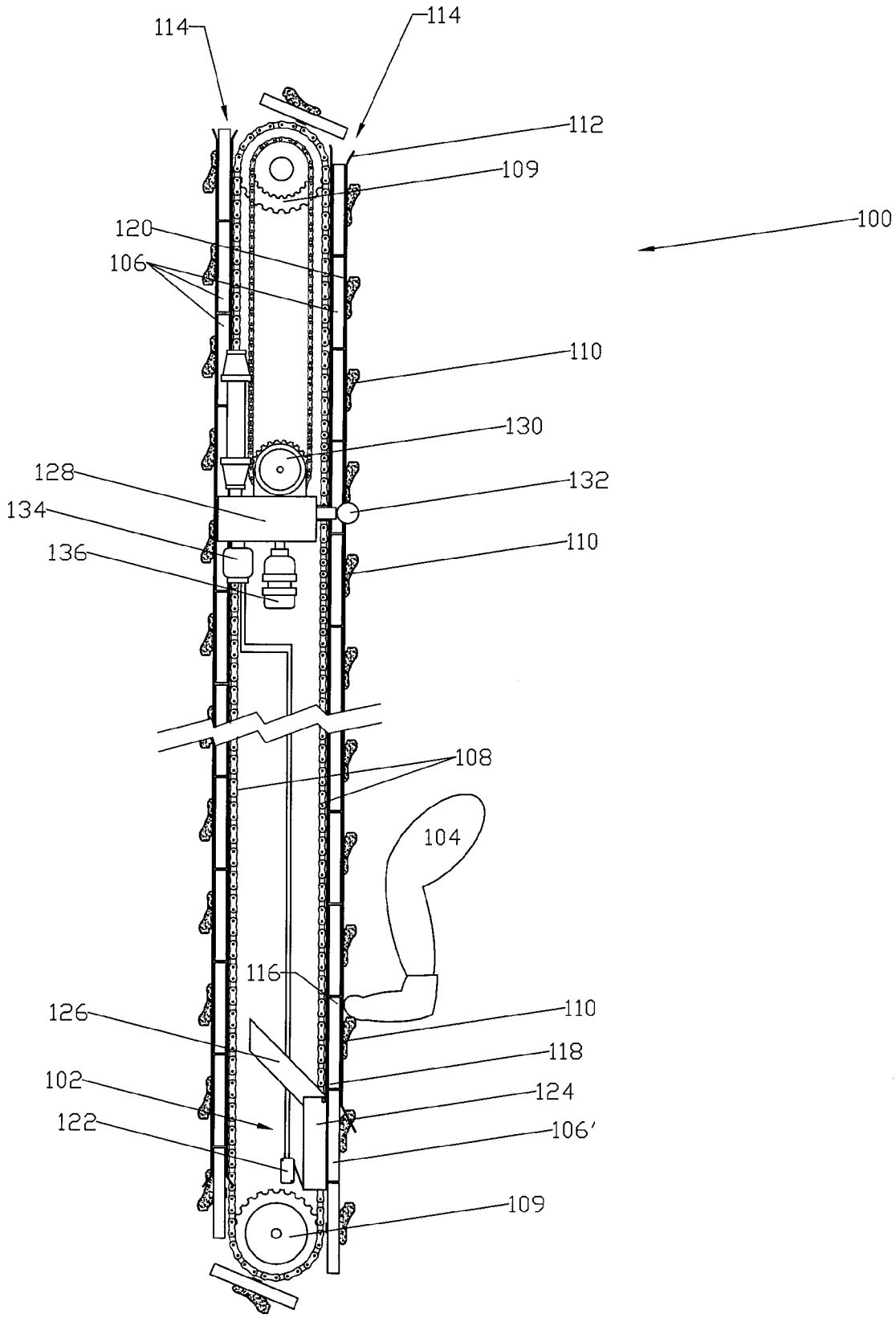
FIG. 1 illustrates a sliding climbing wall that includes a braking actuator mechanism according to the present invention that is in the disengaged mode with a climber climbing the climbing wall.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

It should be understood that the individual steps of the methods of the present invention may be performed in any order and/or simultaneously as long as the invention remains operable. Furthermore, it should be understood that the apparatus and methods of the present invention can include any number or all of the described embodiments as long as the invention remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

A desirable feature of sliding climbing walls is a braking, clutching, or arresting mechanism which stops the movement of the climbing wall when the climbing wall has lowered the climber to a point close to ground level or to some predetermined position. This mechanism stops the climbing wall to accommodate the climber when the climber needs time to plan a move, to rest, or to terminate the climbing activity.

Thus, one aspect of the present invention is a braking, clutching, or arresting means that stops the climbing wall after the climber terminates the climbing activity. Various means are possible to provide this braking, clutching, or arresting action of the climbing wall. There are several mechanisms for electrically, mechanically, or hydraulically braking a climbing wall. These mechanisms all involve on some means to sense when the climber is at the appropriate height or a predetermined position.

For example, some known climbing walls with continuous sliding belts use a cord attached to the climber that runs through pulleys to a hydraulic valve or switch that is used to brake the climbing wall. Such cords can be effective, but they are inconvenient for the climber and can create maintenance issues. Other known climbing walls with continuous sliding belts use photodetector based sensors to indicate when the climber's foot is near ground level. The photodetector based sensors generate an electrical signal that when applied to the braking actuator mechanism instructs the braking actuator mechanism to engage thereby preventing the climbing wall from sliding. Such photodetector based sensor systems can be effective, but are relatively expensive and they are prone to misalignment, which creases maintenance issues.

The climbing wall braking actuator mechanism of the present invention uses the climber's own weight to actuate a relatively inexpensive switch that signals the braking actuator mechanism. That is, when the climbing wall is loaded with a climber in a certain location, the climbing wall actuates a switch that signals the braking actuator mechanism to prevent the climbing wall from sliding.

FIG. 1 illustrates a sliding climbing wall 100 that includes a braking actuator mechanism 102 according to the present invention that is in the disengaged mode with a climber 104 climbing the climbing wall 100. The climbing wall 100 includes a plurality of climbing panels 106 that are connected together to form a vertical chain loop 108 that is transported by gears 109. In one commercial embodiment, each of these individual panels is about 4-6 feet wide, about 6 inches high, and about ¾ inch thick.

Climbing protrusions or climbing holds 110 are attached to the plurality of climbing panels 106 for the climber 104 to grasps with his hands or stand on with his feet for support. These climbing holds 110 can include surfaces that have irregular shapes to simulate natural rock formations and the feel of natural rock climbing. The climbing holds 110 allow the climber 104 to ascend, descend, or traverse the climbing wall 100. In some embodiments, the climbing holds 110 can be detached and then re-positioned in different locations on the climbing surface to change and/or customize the climbing experience for the climber 104. The climbing holds 110 are available in a variety of shapes and sizes to further modify the climbing surface.

The individual climbing panels 106 have a tendency to rotate or pivot around a pivot point when they experience the torque of a climber 104 climbing on the climbing wall 100. In the embodiment shown, this torque is prevented by using a frame 112 that forms a guiding channel 114 at each side of the climbing wall 100 to constrain the plurality of climbing panels 106 at right angles to their sliding motion. When an individual panel 106 is un-weighted (i.e. not supporting the weight of the climber 104), it slides down these guiding channels 114 with very little twisting moment and, therefore, very little frictional force is transmitted to the guiding channels 114.

The individual panels 106 supporting the climber 104, however, experience considerable torque, and this torque results in forces against the guiding channels 114 by the top outside corner 116 and bottom inside corner 118 of the panels 106.

In one embodiment the guiding channels 114 comprise a liner 120 that is designed to reduce friction to the forces against the guiding channels 114 by the top outside corner 116 and bottom inside corner 118 of the panels 106. For example, the liner 120 can include a foam like material. Using a liner 120 with a foam like material will reduce friction and will also reduce noise generated when the plurality of climbing panels 106 slide in the guiding channels 114.

The braking actuator mechanism 102 of the present invention uses the torque applied to the individual panels 106 to engage an actuator 122 that releases an arresting or braking force on the plurality of panels 106 which prevents the climbing wall 100 from sliding. Numerous types of actuators which are known in the art can be used. In various embodiments, the actuator 122 can be a mechanical actuator, an electrical actuator, or a hydraulic actuator.

The braking actuator mechanism 102 includes a hinged section 124 at the bottom of the guiding channels 114 that pivots inward when it experiences the torque of a panel 106 that is loaded with the weight of a climber 104. The liner 120 can be positioned so that it covers the joint connecting the hinged section to the frame 112. In some embodiments, the climbing wall 100 includes more than one braking actuator mechanism 102 and hinged section 124. For example, in these embodiments, there can be a first braking actuator mechanism 102 near the bottom of the climbing wall 100 as shown in FIG. 1 and a second braking actuator mechanism 102 somewhere along the climbing wall 100 that allows the climber to stop the climbing wall at some other location on the climbing wall 100, such as on the top of the climbing wall.

The braking actuator mechanism 102 physically engages the actuator 122. For example, in the embodiment shown, the actuator 122 is engaged by torque generated by the hinged section 124 when one of the plurality of panels 106 pivots out of the guiding channel 114 and into the hinged section 124. In one embodiment, the hinged section 124 includes a spring or counterweight 126 that regulates the amount of force that is required to be applied to the hinged section in order to fully engage the actuator 122.

The actuator 122 is coupled to a brake 124 that applies an arresting force to the plurality of panels 106 when the actuator 122 is engaged. The arresting force retards the sliding motion of the plurality of panels 106. In many embodiments, the brake 128 completely prevents the plurality of panels from sliding soon after the actuator 122 is engaged. Numerous types of brakes known in the art can be used. In various embodiments, the brake 128 can be a clutch or other type of mechanical brake that applies sufficient frictional forces to the plurality of panels 106 or to the vertical chain loop 108 connecting the plurality of panels 106 to retard the sliding motion of the plurality of panels 106 so as to stop the motion of the climbing wall 100.

Figure 2:
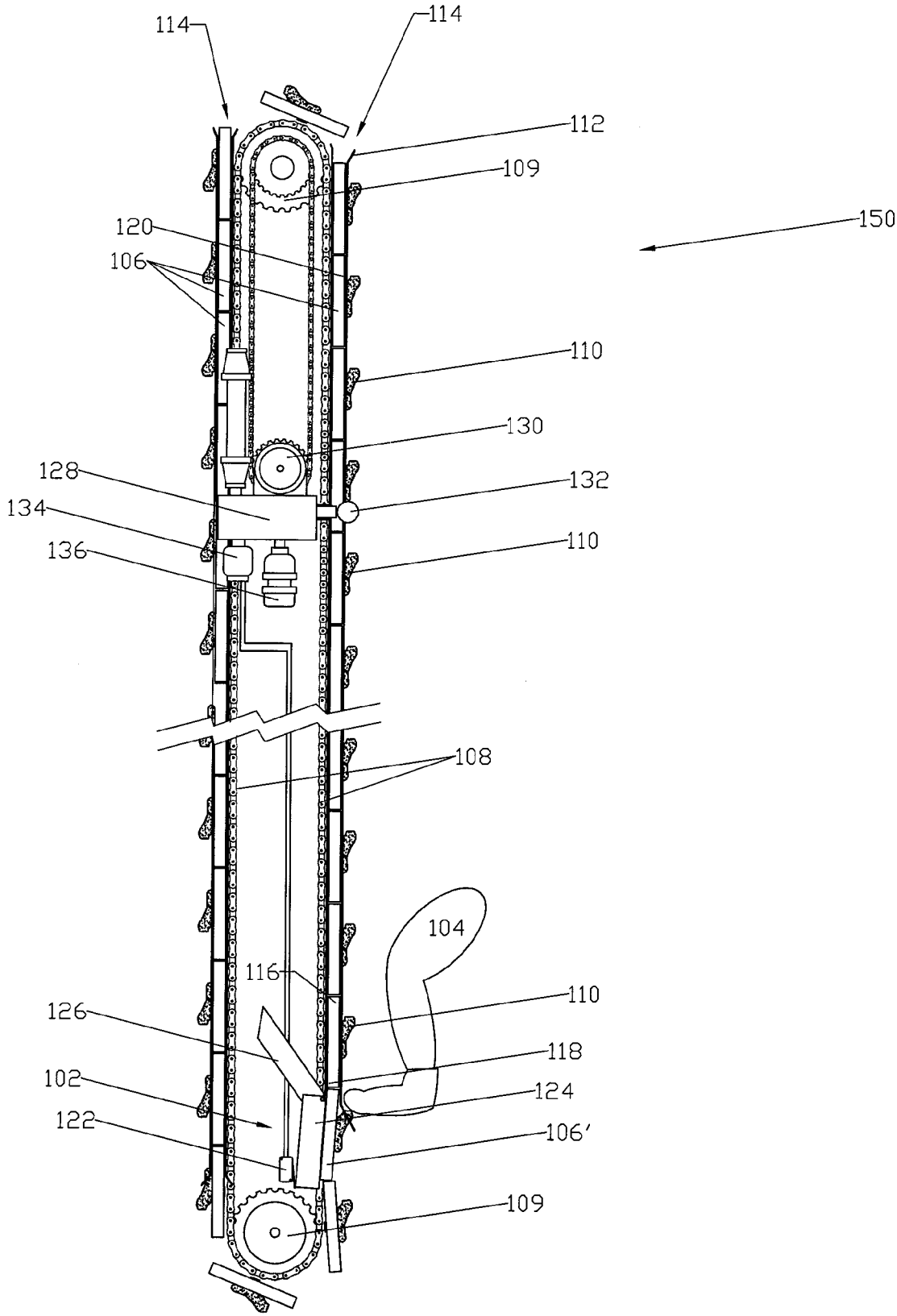
FIG. 2 illustrates a sliding climbing wall that includes a braking actuator mechanism according to the present invention in the engaged mode with a climber resting or leaving the wall.

In the embodiment shown in FIG. 2, the brake 128 is a hydraulic brake that includes a hydraulic pump 130 and a flow control valve 132 that regulates the sliding rate of the plurality of panels 106 by applying the desired amount of frictional force to the plurality of panels 106 or to the vertical chain loop 108 connecting the plurality of panels 106. The brake 128 also includes a solenoid valve 134 that stops the flow of hydraulic oil when the brake 128 is engaged by the actuator 122, which retards the sliding motion of the plurality of panels 106 so as to stop the motion of the climbing wall 100. In some embodiments, a shock absorber 136 is positioned on the bottom of the brake 128 (or some other part of the climbing wall 100) to absorb some of the force when the climber 104 reaches the bottom of the climbing wall 100.

In the diagram shown in FIG. 1, the braking actuator mechanism 102 is in the disengaged mode with the climber 104 actively climbing the climber wall 100. In the diagram shown in FIG. 1, the actuator 122 is not engaged because there is not enough torque on the un-weighted bottom panel 106' to force the hinged section 112 back against the actuator 122.

FIG. 2 illustrates a sliding climbing 150 wall that includes a braking actuator mechanism 102 according to the present invention that is in the engaged mode with a climber 104 leaving the wall. FIG. 2 shows the hinged section 124 when it is weighted by the climber 104. When the bottom panel 106' passes into the hinged section 124, the weight of the climber's foot is great enough to force the hinged section 124 back against the actuator 122 so that the hinged section 124 physically engages the actuator 122. The engaged actuator 122 then actuates the brake 128 which retards the sliding motion of the plurality of panels 106 so as to stop the motion of the climbing wall 100. In many embodiments, the brake 128 completely stops the sliding motion of the climbing wall 150.

The actuator 122 is subsequently disengaged when the climber's foot moves upward and un-weights the bottom panel 106'. When the bottom panel 106' is un-weighted, the torque is removed from the bottom panel 106' so as to allow the bottom panel 106' to pivot away from the actuator 122 which disengages the brake 128 of the climbing wall 150 and allows the climber 104 to continue to climb the climbing wall 150.

EQUIVALENTS

While the present teachings are described in conjunction with various embodiments and examples, it is not intended that the present teachings be limited to such embodiments. On the contrary, the present teachings encompass various alternatives, modifications and equivalents, as will be appreciated by those of skill in the art, may be made therein without departing from the spirit and scope of the invention.

What is claimed is:

1. A climbing wall comprising:

a. a frame forming a guiding channel attached to an endless chain, the guiding channel having a longitudinal axis that is oriented in a substantially vertical direction;

b. a plurality of panels attached to the endless chain that slide in the guiding channels so as to form a climbing surface having climbing holds for climbing, the frame including a section where the plurality of panels pivot out of the guiding channel when loaded with a climber's weight;

c. an actuator that is engaged by torque generated when one of the plurality of panels pivots out of the guiding channel towards the endless chain; and d. a brake coupled to the actuator, the brake applying an arresting force to the plurality of panels when the actuator is engaged.

2. The climbing wall of claim 1 wherein the section where the plurality of panels pivots out of the guiding channel comprises a hinged section.

3. The climbing wall of claim 1 wherein the actuator comprises an electrical switch.

4. The climbing wall of claim 1 wherein the actuator comprises a mechanical switch.

5. The climbing wall of claim 1 wherein the brake comprises a clutch mechanism.

6. The climbing wall of claim 1 wherein the brake comprises a hydraulic brake.

7. The climbing wall of claim 1 further comprising a shock absorber.

8. The climbing wall of claim 1 further comprising a liner that is positioned in the frame that reduces friction caused by forces generated by the plurality of panels sliding through the frame.

9. The climbing wall of claim 8 wherein the liner comprises a foam material.

10. The climbing wall of claim 1 wherein the arresting force applied to the plurality of panels prevents the plurality of panels from sliding in the frame.

11. The climbing wall of claim 1 wherein the frame comprises at least two sections where the plurality of panels pivot out of the guiding channel when loaded with the climber's weight.

12. The climbing wall of claim 1 wherein the section where the plurality of panels pivot out of the guiding channel when loaded with the climber's weight is positioned at a base of the climbing wall.

13. A climbing wall comprising:

a. a frame attached to an endless chain;

b. a plurality of panels attached to the endless chain so as to form a climbing surface having climbing holds for climbing;

c. means for guiding the plurality of panels so that they slide when a climber applies weight to at least one of the plurality panels, wherein the means for guiding the plurality of panels comprises a guiding channel attached to the frame having a longitudinal axis that is oriented in a substantially vertical direction;

d. an actuator means that is engaged by torque generated when one of the plurality of panels pivots out of the guiding means towards the endless chain; and e. a braking means that applies an arresting force to the plurality of panels when the actuator means is engaged.

14. The climbing wall of claim 13 wherein the arresting force prevents the plurality of panels from sliding.

15. The climbing wall of claim 13 wherein the actuator means is mechanical actuated.

16. The climbing wall of claim 13 wherein the actuator means is electrically actuated.

17. The climbing wall of claim 13 wherein the braking means is mechanical.

18. The climbing wall of claim 13 wherein the braking means is hydraulic.

19. The climbing wall of claim 13 further comprising a means for reducing friction caused by forces generated when the plurality of panels pivots out of the guiding means.

* * * * *